US005211681A

United States Patent [19]

Penisson

[11] Patent Number: 5,211,681

[45] Date of Patent: May 18, 1993

[54] SYSTEM FOR MAKING UP OR BREAKING OUT THREADED JOINTS OF PIPE

[75] Inventor: Dennis J. Penisson, Raceland, La.

[73] Assignee: Bilco Tools, Inc., Houma, La.

[21] Appl. No.: 830,682

[22] Filed: Feb. 4, 1992

[51] Int. Cl.[5] ..... B25B 21/00

[52] U.S. Cl. ..... 81/57.19; 81/57.34; 81/57.16

[58] Field of Search ..... 81/57.14–57.16, 81/57.18, 57.19, 57.2, 57.21, 57.33, 57.34

[56] References Cited

U.S. PATENT DOCUMENTS 2,721,284 12/1987 Coyle, Sr. et al. ..... 29/240

*Primary Examiner*—D. S. Meislin

*Attorney, Agent, or Firm*—Vaden, Eickenroht, Thompson, Boulware & Feather

[57] ABSTRACT

There is disclosed a system for use in making up or breaking out threaded joints of pipe which includes a power tong having a head rotatably mounted on a housing and jaws on the head movable into and out of positions gripping the joint for rotation with the head in response to the supply thereto and exhaust therefrom of fluid under pressure. A conduit connecting the fluid reservoir with pistons on the jaws includes a coupling having readily connectible and disconnectible parts, with a check valve and a vent valve installed in one end of the conduit between the check valve and the jaws, so that fluid pressure may be maintained on the pistons when the vent valve is closed and exhausted from the pistons upon opening of the vent valve. .

6 Claims, 1 Drawing Sheet

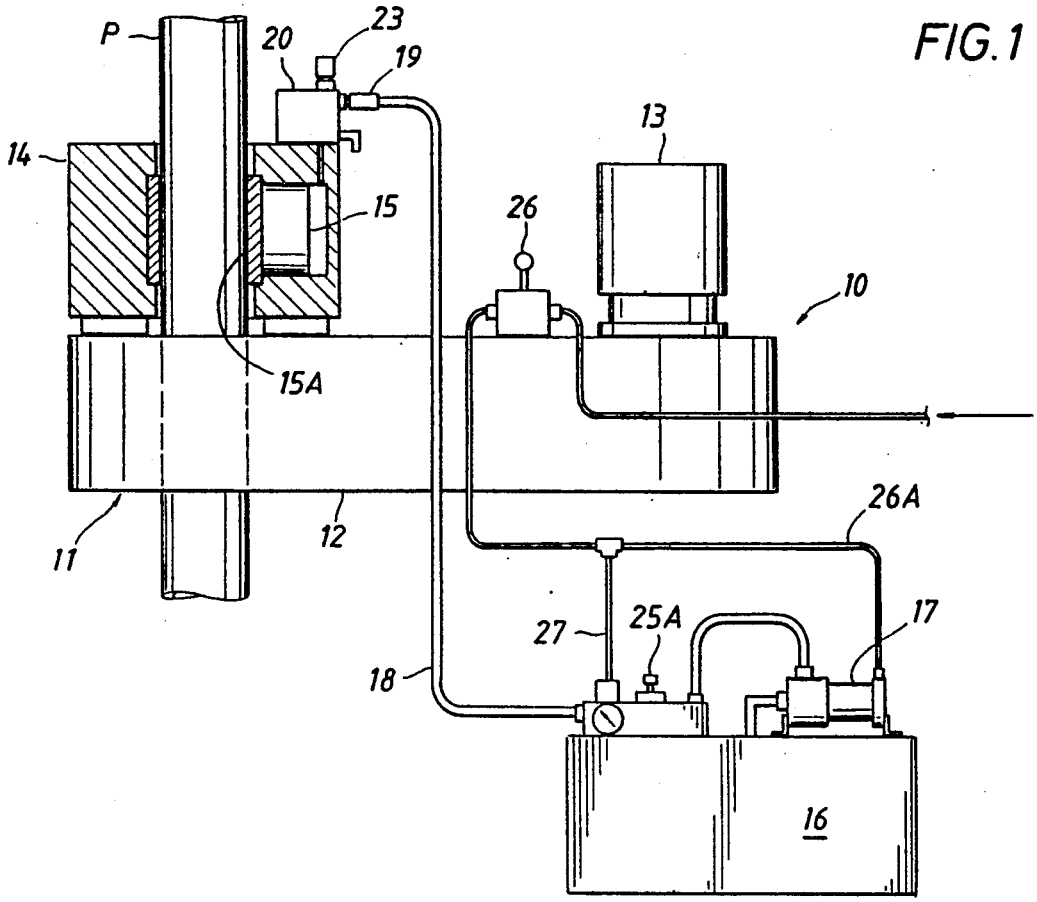
FIG. 1
FIG. 2
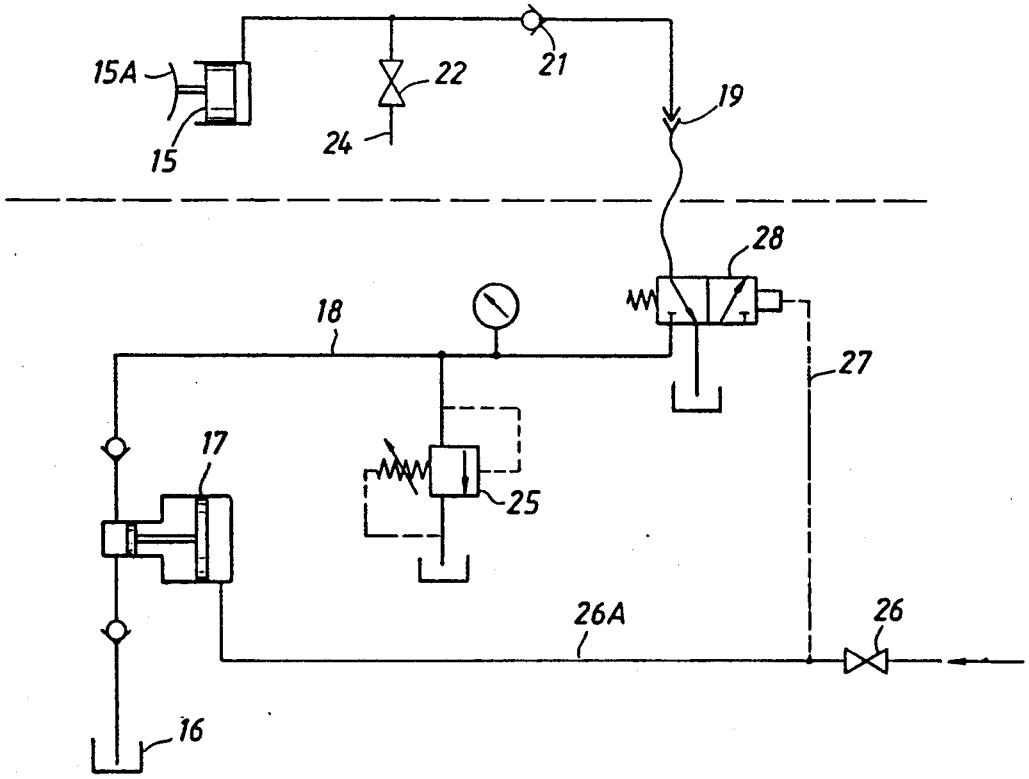

SYSTEM FOR MAKING UP OR BREAKING OUT THREADED JOINTS OF PIPE

This invention relates generally to a system for making up or breaking out threaded joints of pipe which includes a power tong for gripping and rotating one such joint with respect to the other. More particularly, it relates to improvements in such systems in which one joint is gripped by means on a head rotatable within the housing or body of the tong independently of the torque by which the head itself is rotated.

As well known in the art, a power tong for making up or breaking out threaded joints of pipe, such as well pipe, conventionally comprises a body or housing which is held against rotation and a head which is mounted for rotation with respect to the body by a suitable motor, each of the body and head having slots which, when aligned, permit them to be moved over the joint into or out of a position in which the axis of rotation of the head is aligned with pipe. More particularly, conventional tongs of this type include jaws which are carried on the head in position to be swung inwardly against the pipe by cams on the housing as the head is rotated with respect to the housing. As a result, the jaws are forced against the pipe with a force proportional to the torque for rotating the head.

Pat. No. 4,712,284 discloses an improvement upon these more conventional power tongs in that jaws for gripping the pipe are moved against the pipe by means which is independent of the power source which rotates the head, and thus with a force independent of the torque applied to the head for rotating it with respect to the body. This may be particularly useful, for example, where the nature of the joint is such that it must be gripped with a lessor force to avoid damaging it.

More particularly, jaws are formed on the inner ends of pistons which are mounted on the head for movement into pipe gripping positions by fluid under pressure supplied thereto from a suitable reservoir by means of an air driven pump. More particularly, one way check valves in the conduit connecting the reservoir to the pistons maintain the pressure on the jaws during make up or break out, while a valve in a parallel conduit permits the fluid between each check valve and piston to be bled back to the reservoir when the pipe has been made up or broken out and the tong is to be removed therefrom.

Although this system has proven to be quite successful, it nevertheless is difficult to use with a small tong, when, for example, the joint is one of multiple parallel strings of pipe. That is, the large and bulky reservoir and pump which are mounted on the head may prevent the tong from getting between the strings. An object of this invention is to provide a system of the type described having a power tong which is so constructed and arranged as to make it particularly useful as a small tong for this and other purposes.

This and other objects are accomplished, in accordance with the illustrated embodiment of the invention, by such a system having a power tong in which a conduit for supplying fluid from a reservoir to means for moving the pipe gripping means into engagement with the joint includes a coupling having a first part on a first end of the conduit leading to the moving means and a second part on a second end of the conduit leading from the fluid supplying means and releasably connected to the first part. A check valve in the first end of the conduit permits flow only to the moving means, and a means is provided for venting fluid from the first end of the conduit intermediate the moving means and check valve. More particularly, the check valve, the venting means and the coupling are mounted on and rotatable with the head while the pressure fluid supplying means is supported on the housing or another location which does not rotate with the head.

Consequently, with the venting means closed and the coupling parts connected, fluid may be supplied to the means on the head for moving the gripping means into engagement with a joint pipe to be made up or broken out. With the pipe thus held for rotation with the head, the second coupling part may be disconnected from the first part to permit the head to be rotated with respect to the housing in order to make up or break out the joint pipe.

Then, the venting means may be opened to vent fluid from the first end of the conduit and thus the means holding the gripping means into engagement with the pipe. This of course, can be accomplished easily regardless of the position of the rotatable head with respect to the housing. Upon venting of this fluid, the head may be again rotated to move its slot into alignment with the slot in the housing to permit the tong to be removed from the joint. Obviously, in order to again rotate a joint of pipe, the venting means is closed and the second coupling part is reconnected to the first coupling part when the tong has been installed in the pipe, whereby the gripping means may again be moved into engagement with the pipe.

In accordance with the preferred and illustrated embodiment of the invention, the system also includes a means which, in response to the discontinuance of the supply of pressure fluid, exhausts fluid from the second end of the conduit intermediate the second coupling part and the pressure fluid supplying means. This then prevents the damage to the operator and the surrounding environment due to high pressure of the fluid as the second coupling part is disconnected from the first part.

As shown, the pressure fluid supplying means comprises a pump which is responsive to the supply of fluid thereto from a second source of pressure fluid, and the means for exhausting fluid from the second end of the conduit comprises valve means in the second end of the conduit which is normally urged to exhausting position, but moved to a position opening the conduit responsive to the supply of the second source of fluid to the pump.

As illustrated, the gripping means includes a jaw at the inner end of a piston which is mounted on the head for radial movement with respect thereto, and in this respect, the tong is similar to that of the aforementioned U.S. Pat. No. 4,712,284. However, this invention contemplates that the gripping means and the means by which it is moved into gripping engagement with the joint may be of other construction.

In the drawings, wherein like reference characters are used throughout to designate like parts:

FIG. 1 is an elevational view of a system including a tong constructed in accordance with the present invention, and showing the pistons on the jaws for gripping the pipe in cross-sectional view; and FIG. 2 is a diagrammatic illustration of the hydraulic circuit for operating the tong, and having a broken line to separate parts above it which are mounted on the head from those below it which are mounted on the housing or the rig floor or other location not rotatable with the head.

With reference now to the detailed description of the above described drawings; the overall system, which is indicated in its entirety in FIG. 1 by reference character 10 includes a power tong 11 having a housing 12 adapted to be held in any suitable manner against the rotation, and a head (not shown) mounted for rotation within the housing by means of a motor 13 mounted to one end of the housing opposite the head. As well known in the art, each of the housing and the head are provided with slots in one side which, when aligned, permit the tong to be moved over a pipe joint P into a position in which the axis of rotation of the head is aligned with the axis of the pipe.

As also shown in FIG. 1, a body 14 is mounted on the head for rotation therewith and has an opening therethrough to receive the joint of pipe P. More particularly, as shown, for example, in the aforementioned patent, one or more pistons 15 having jaws 15A on their inner ends are mounted for radial movement within cylinders in the body between inner positions gripping the pipe and outer positions permitting the head to rotate with respect to the pipe. With the other joint of pipe to which the pipe joint P is to be connected being held against rotation, as by means of backup rams, the motor 13 may be started to rotate the head and thus the pipe to either make up or break out the joint between it and the other joint of pipe.

As shown in FIG. 1, the system also includes a fluid reservoir 16 which is mounted at some location which is not rotatable with the head of the tong, as for example on the rig floor or even on the housing of the tong. A pump 17 is mounted on the reservoir for drawing fluid from the reservoir and supplying it through a conduit 18 to the cylinders for the pistons 15.

A coupling 19 is mounted on a manifold 20 which is installed on the upper end of the body 14 and which has passageways therethrough connecting with passageways in the head 14 leading to the cylinder behind piston 15. As previously described, the coupling 19 is made of readily connectible and disconnectible parts, one of which is mounted on a first end of the conduit leading to the piston and the second of which is on the end of the conduit 18 leading to the pump 17.

A check valve 21 (see FIG. 2) located within the manifold prevents flow in a direction away from the piston 15, and a vent valve 22 (see FIG. 2) is installed in the manifold passageway for venting the conduit intermediate the check valve and the piston. As indicated in FIG. 1, the vent valve may be selectively opened and closed by means of a button 23 at the top of the manifold 20.

As previously described, when the jaws are to be moved into gripping engagement with the pipe, the coupling is connected and vent valve 22 is closed so that fluid supplied through conduit 18 is held on the piston by valve 1. When the gripping engagement of the jaws is to be released, the vent valve 22 is opened to permit fluid trapped between the piston and the check valve 21 to drain through line 24. If desired, this fluid may be collected in a small reservoir or container on the head. Alternatively, the fluid may be so selected that it may be dumped to the environment without risk.

A pressure relief valve 25, best shown in FIG. 2, is installed in a manifold mounted on the reservoir and to which conduit 18 is connected for venting or exhausting fluid when it reaches a predetermined pressure, thus providing control of the fluid supplied to the piston. As shown in FIG. 1, the valve may be opened by a button 25A on the manifold.

As previously described, the pump 17 is adapted to be operated by air supplied thereto from a suitable source upon opening of valve 26 in a conduit 26A leading to a piston on the pump. Additionally, a conduit 27 connects the conduit 26 to a valve 28 (see FIG. 1) for opening and closing the conduit 18 in response to the supply of air to the pump or the discontinuing of air to the pump, respectively. Consequently, when the pump is supplying pressure fluid to the piston, the valve is open, but when the air supply is interrupted so that the pump does not continue to supply fluid, the valve is closed.

More particularly, as is shown in its illustrated embodiment, the valve 28 has a valve member which is normally spring pressed to the right so as to exhaust fluid in the conduit into a reservoir, which may be the reservoir 16. However, upon the supply of air to fluid responsive means on the valve, in order to operate the pump 17, valve 27 is shifted to a position supplying the fluid under pressure from reservoir 16 to the piston.

Reviewing now the overall operation of the system, and assuming the tong has been installed on a pipe for rotating it, as shown in FIG. 1, and the coupling 19 is made up and vent valve 22 is closed, opening of the valve 26 will automatically shift the valve 27 to the left so as to supply fluid from the reservoir 16 to the cylinder behind the piston as it begins to operate the pump. With pressure fluid maintaining the jaws engaged with the pipe by means of the check valve 21 and the closed vent valve 22, the second coupling part may be disconnected from the first to permit the head to be rotated with respect to the housing in order to make up or break out the joint of point. Then, when make up or break out has been completed, and the operator wishes to remove the tong from the pipe, it is only necessary to open the vent valve 22 and thus exhaust pressure fluid from the outer side of the piston. From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. In a system for making up or breaking out threaded joints of pipe, a power tong comprising a housing, a head rotatably mounted on the housing, each of the housing and head having slots adapted to be aligned with one another to receive a joint along the axis of rotation of the head, means on the head having gripping means movable into and out of positions gripping the joint to cause the joint to rotate with the head when gripped by the gripping means, moving means for so moving the gripping means into gripping position in response to the supply thereto of fluid under pressure, a fluid reservoir, means including a pump for drawing fluid from the reservoir and a conduit connecting the pump to the moving means for supplying fluid from the reservoir under pressure to the moving means, said conduit having a first portion leading to the moving means and a second portion leading from the pump and including a coupling having a first part on one end of the first portion of the conduit and a second part on one end of the second portion of the conduit and releasably connected to the first part, said first portion of the conduit also including means for venting fluid from the first portion of the conduit intermediate the moving means and check valve so as to permit the gripping means to move out of gripping position, said reservoir and pump being supported at a location which does not rotate with the head.

2. In a system of the character defined in claim 1, including means automatically responsive to the discontinuance of the supply of pressure fluid for exhausting fluid in the second portion of the conduit intermediate the second coupling part and the pump.

3. In a system of the character defined in claim 2, wherein the pump has means responsive to the supply of fluid thereto from a source other than the reservoir.

4. In a system of the character defined in claim 3, wherein said means for exhausting fluid in the second portion of the conduit comprises a valve means connected to the second conduit portion and normally urged to exhausting position and moved to a position opening the conduit responsive to supply of fluid from the source to the pump.

5. In a system of the character defined in claim 1, including means for controlling the pressure of the fluid from the reservoir.

6. In a system of the character defined in claim 1, wherein the moving means comprises a piston which is mounted on the head for radial movement with respect thereto and to which the fluid is supplied for moving the piston, and said gripping means includes a jaw on the inner end of the piston.

* * * * *